US005761567A

United States Patent [19]

Yoshizuka

[11] Patent Number: 5,761,567

[45] Date of Patent: Jun. 2, 1998

[54] IMAGE FORMING APPARATUS WITH JAM DETECTION FOR PERMITTING COMPLETION OF A COPY OPERATION

[75] Inventor: Ken Yoshizuka, Osaka, Japan

[73] Assignee: Mita Industrial Co., Ltd., Osaka, Japan

[21] Appl. No.: 607,981

[22] Filed: Mar. 4, 1996

[30] Foreign Application Priority Data

Mar. 6, 1995 [JP] Japan ..... 7-045789
Mar. 6, 1995 [JP] Japan ..... 7-045837

[51] Int. Cl.[6] ..... G03G 15/00

[52] U.S. Cl. ..... 399/17; 271/3.13; 399/18; 399/20; 399/21

[58] Field of Search ..... 399/16–18, 20, 399/21; 271/3.01, 3.13, 3.15, 3.17

[56] References Cited

U.S. PATENT DOCUMENTS 4,730,204 3/1988 Satoh et al. ..... 399/17
4,786,041 11/1988 Acquaviva et al. ..... 271/3.13
5,081,490 1/1992 Wakao ..... 399/17
5,311,254 5/1994 Watanabe ..... 399/17

*Primary Examiner*—William J. Royer
*Attorney, Agent, or Firm*—Jordan and Hamburg

[57] ABSTRACT

An image forming apparatus is provided with a document feeder for feeding a document to an image scanning portion for scanning an image of the document, a document jam detector for detecting a jam of the document in the document feeder, and a controller for, when the document jam detector detects the jam of the document, stopping an entire image forming operation after completing a specified operation. Since the specified operation is completed upon detection of the document jam, the document to be copied when the image forming operation is resumed after removal of the jammed document can be clearly distinguished from the other. The image forming apparatus can be more rapidly resumed.

7 Claims, 6 Drawing Sheets

IMAGE FORMING APPARATUS WITH JAM DETECTION FOR PERMITTING COMPLETION OF A COPY OPERATION

BACKGROUND OF THE INVENTION

This invention relates to an image forming apparatus provided with a document feeder for successively feeding documents placed on a document setting portion to a specified position on a glass document platen.

There is known an image forming apparatus which is provided with a document feeder for successively feeding documents placed on a document bin to a specified position on a glass document platen and performs an image forming operation in synchronism with the feeding operation of the document feeder.

In recent years, there have been proposed image forming apparatuses which can form an image remarkably faster than the existing image forming apparatuses. In such apparatuses, when images of a plurality of documents are copied, a document having its image scanned is discharged to a discharging device before completion of the latter half of the copying operation for this document, and a next document is fed to an image reading position. Further, the reading of the document image is started while the document is being fed, not after the document is completely fed to the image reading position. In these apparatuses, upon detection of a jam of a document in the document feeder, the entire image forming operation is immediately stopped. Such high speed image forming apparatuses have the following problems.

When a jam of the former document to be discharged to the discharging device is detected after completion of scanning of the image, the next document may be already set in the image scanning position and the image scanning operation therefor may already be started. In other words, when the jam of the former document is detected, the next document may be copied at the same time the former document is being copied. In such a case, if the entire image forming operation is stopped upon detecting the jam of the former document, it is unclear how far the former and next documents have been copied. This is prominent when an image of one document is copied on a plurality of copy sheets. If an operator resumes the copying operation based on his instinct, more or less document images than intended may be formed.

In view of this, there is a demand for an image forming apparatus which can accurately discriminate a document to be copied when an image forming operation is resumed after a jam in a document feeder is dealt with and can securely prevent a document image from being copied more or less than intended.

Further, in the above high speed image forming apparatuses, when the next document is fed to the image scanning position, the image scanning for the next document is started and a copy sheet on which the next document image is to be copied is fed. Accordingly, if the document is jammed while it is fed to the image reading position, the copy sheet is already fed to the apparatus main body.

The above image forming apparatuses are provided with two separate copy sheet discharging portions: one for discharging a copy sheet which has not been used due to the jam of the document and the other for discharging a copy sheet bearing a copied image. Specifically, upon detecting the jam of the document, the entire image forming operation, including a transport of the copy sheet which has not been used, is stopped. Next, upon confirming a discharge of the copy sheet bearing the copied image to a specified copy sheet discharging portion, the transport of the unused copy sheet is resumed and a discharging direction of this copy sheet is switched so that the unused copy sheet is discharged to another copy sheet discharging device different from the specified one.

According to the above copy sheet discharging method, the transport of the copy sheet is stopped after detection of the jam of the document until the discharge of the copy sheet bearing a normally copied image to the discharging device is confirmed. Thus, a processing to deal with the jammed document can be rapidly performed. Further, in the case that a single document is to be copied on a plurality of copy sheets, copy sheets are fed one after another at high speed from a copy sheet feeder. However, it is difficult to accurately stop the copy sheets being continuously fed at high speed in specified positions. Accordingly, if the feed of the copy sheets is stopped upon detection of the jam of the document, the copy sheets may become motionless, being placed one over another. As a result, the copy sheets are likely to get jammed.

In view of the above, there is a demand for an image forming apparatus which can rapidly deal with a jam when a document is jammed during the use of a document feeder and effectively prevent a copy sheet from getting jammed.

SUMMARY OF THE INVENTION

It is an object of the invention to provide an image forming apparatus which has overcome the problems residing in the prior art.

It is another object of the invention to provide an image forming apparatus which can discriminate the kind of a document jam which occurs while a document is being transported and change a control for an image forming operation depending upon the discriminated kind of the document jam.

It is another object of the invention to provide an image forming apparatus which can, when a document is jammed during the use of a document feeder, rapidly deal with a jammed document and effectively prevent copy sheets from getting jammed.

Accordingly, the invention is directed to an image forming apparatus, comprising a document feeder which feeds a document to an image scanning portion for scanning an image of the document, a document jam detector which detects a jam of the document in the document feeder, and a controller which stops, when the document jam detector detects the document jam, the entire image forming operation after completing a specified operation.

The document feeder may be provided with a document setting portion for setting documents to be fed to the image scanning portion and a document discharging assembly for receiving the documents discharged from the image scanning portion to set a next document in the image scanning portion while the former document is discharged to the document discharging assembly. The document jam detector may be provided with a discharge document jam detecting device which detects a document jam in the document discharging assembly which allows a next document to be set in the image scanning portion. The controller may be provided with an imaging control device which completes the image forming operation for the next document when the discharge document jam detecting device detects the document jam in the document discharging assembly.

The image forming apparatus may be further provided with a copy number setting device which sets the number of copies to be made for each document to be fed to the image scanning portion, and a copy sheet transporting assembly for continuously transporting as many copy sheets as the copy number set by the copy number setting device to an imaging assembly for forming the document image on the copy sheets. In this image forming apparatus, the imaging controlling device may cause the image forming operation to be performed, for the next document, as many times as the copy number set by the copy number setting device.

The discharge document jam detecting device may be provided with a first detecting device which detects the trailing end of the document to be discharged has completely left the image scanning portion, and a second detecting device which is disposed downstream from the first detecting device and detects that the document has discharged from the document feeder. The discharge document jam detecting device may detect the document jam in the document discharging assembly when the first detecting device detects a departure of the document from the image scanning portion, but the second detecting device does not detect a discharge of the document from the document feeder.

The image forming apparatus may be further provided with a first copy sheet discharging portion for receiving the discharged copy sheet bearing a copied image, a second copy sheet discharging portion for receiving the discharged copy sheet bearing no copied image, a switching portion for switching a discharging direction of the copy sheet to the first copy sheet discharging portion to another discharging direction to the second copy sheet discharging portion, and a position detecting device which detects that the trailing end of the copy sheet bearing the copied image has reached the switching portion. The controlling device may be provided with a switch controlling device which causes the switching portion to switch the discharging direction upon confirming in accordance with a detection signal from the position detecting device that the trailing end of the copy sheet bearing the copied image has reached the switching portion after detection of the document jam by the document jam detector.

The image forming apparatus may be further provided with a copy number setting device which sets the number of copies to be made for each document to be fed to the image scanning portion, a copy sheet transporting assembly for continuously transporting copy sheets corresponding to the number set by the copy number setting device to an imaging assembly for forming the document image on the copy sheet, and a counter which counts the number of copy sheets discharged from the imaging assembly to the first copy sheet discharging portion. The position detecting device may detect, upon occurrence of the document jam, the trailing end of the copy sheet bearing the copied image in accordance with the copy number set by the copy number setting device and the number of copy sheets counted by the counter.

The position detecting device may be provided with a fixation sensor which detects that the trailing end of the copy sheet bearing the copied image has passed a fixing device for fixing the image onto the copy sheet, and a timer which measures a time required for the trailing end of the copy sheet to reach the switching portion after being detected by the fixation sensor.

With the thus constructed image forming apparatus, upon detection of the document jam in the document feeder for transporting the document to the image scanning portion, the entire image forming operation is stopped upon completion of the specified image forming operation. In other words, since the specified image forming operation is completed upon detection of the document jam, the document to be copied when the image forming operation is resumed is clearly distinguishable after removal of the jammed document. Thus, the image forming operation can be rapidly resumed.

Further, the inventive image forming apparatus is provided with the document feeder for setting the next document in the image scanning portion while the former document is discharged to the document discharging portion. Upon detection of the document jam in the document discharging assembly which allows the next document to be set in the image scanning portion, the image forming operation for the next document is completed. In other words, if the image forming operation for the next document has been already started when the document jam is detected in the discharging assembly, it is completed and then the entire image forming operation is stopped. Accordingly, the properly scanned documents and the improperly scanned documents can be clearly distinguished from each other. This securely prevents the documents from being copied more than or less than intended when the copying operation is resumed after the jammed document is removed, thereby improving the operability of the image forming apparatus and the working efficiency of an operator.

The image forming apparatus is also provided with the copy number setting device which sets the number of copies to be made for each document to be fed to the image scanning portion. Upon detection of the document jam in the document discharging assembly which allows the next document to be set in the image scanning portion, as many copies as the copy number set by the copy number setting device are made for the next document. In other words, the entire image forming operation is stopped after making as many copies as the set copy number. Thus, even if a multitude of copies are to be made for each document, such an incident can be effectively prevented where the document is copied more than or less than intended.

The discharge document jam detecting device includes the first detecting device which detects the trailing end of the document to be discharged has completely left the image scanning portion, and the second detecting device disposed downstream from the first detecting device for detecting that the document has discharged from the document feeder. The discharge document jam detecting device detects the document jam in the document discharging assembly when the first detecting device detects a departure of the document from the image scanning portion, but the second detecting device does not detect a discharge of the document from the document feeder. Thus, the document jam in the document discharging assembly can be securely detected by a simple construction.

Further, the inventive image forming apparatus is provided with the switching portion for switching a discharging direction of the copy sheet depending upon whether the copy sheet bears the copied image or not. When the document jam occurs, the switching portion switches the discharging direction after the trailing end of the copy sheet bearing the copied image is confirmed to have reached the switching portion. In other words, by switching the discharging direction after the trailing end of the copy sheet bearing the copied image reached the switching portion, the copy sheets bearing no copied images are discharged to the copy sheet discharging portion different from the one for the copy sheets bearing copied images. Accordingly, without temporarily stopping the transport of the copy sheets, the copy sheets bearing normally copied images and the copy sheets unused due to the document jam can be suitably discharged to the separate copy sheet discharging portions. This effectively prevents a jam of copy sheets due to a deterred flow thereof resulting from a temporarily stop of transport of the copy sheets, and suitably separates the copy sheets bearing normally copied images and the unused copy sheets bearing no copied image.

The inventive image forming apparatus further comprises the copy number setting device for setting the number of copies to be made for each document to be fed to the image scanning portion, and the counter for counting the number of copy sheets discharged from the imaging assembly to the first copy sheet discharging portion. The trailing end of the copy sheet bearing the copied image is detected in accordance with the copy number set by the copy number setting device and the number of copy sheets counted by the counter. Accordingly, a plurality of copy sheets which have been fed one after another to the copy sheet transporting assembly at specified intervals can be accurately separated into those bearing the copied images and those bearing no copied images.

The position detecting device comprises the fixation sensor for detecting that the trailing end of the copy sheet bearing the copied image has passed the fixing device, and the timer for measuring a time required for the trailing end of the copy sheet to reach the switching portion after being detected by the fixation sensor. The timer is started when the trailing end of the copy sheet bearing the copied image is detected by the fixation sensor. The switching portion switches the discharging direction upon lapse of the predetermined time by the timer. In other words, being constituted by the existing fixation sensor disposed for detecting a jam of the copy sheet in the fixing device or the like, the detecting device is allowed to have a simplified construction.

DETAILED DESCRIPTION OF THE INVENTION

Figure 1:
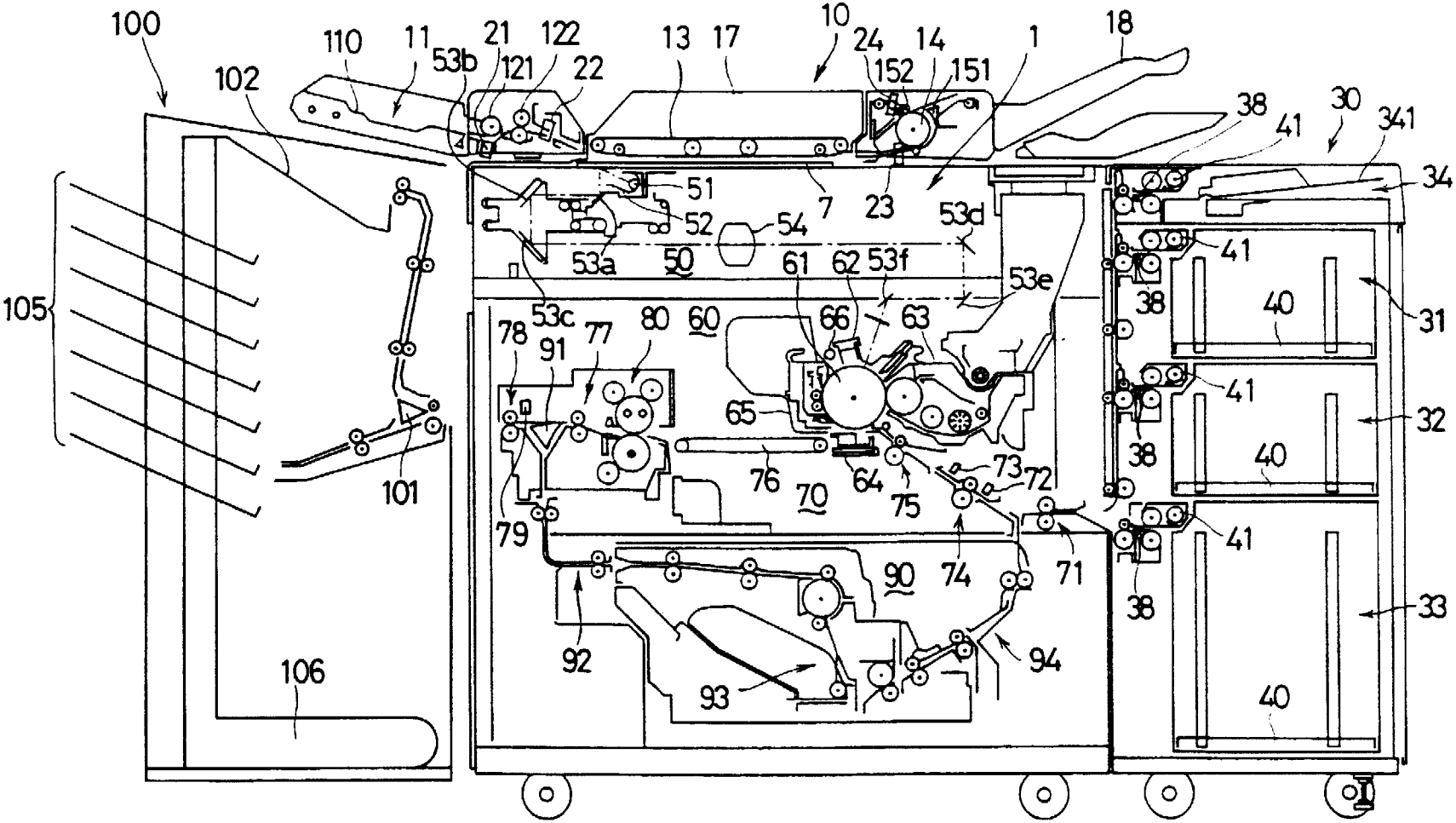
FIG. 1 is a section of an image forming apparatus as one embodiment of the invention.

First, a schematic construction of an image forming apparatus according to the invention is described with reference to FIG. 1.

The image forming apparatus is provided with a main body 1, a document feeder 10 on the top of the main body 1, a copy sheet feeder 30 on the right of the main body 1, and a sorter 100 on the left thereof. The document feeder 10 also acts as a document presser. A document platen of glass (image scanning portion) 7 is disposed in the middle of the upper surface of the main body 1. The main body 1 is provided internally with an optical assembly 50, an imaging assembly 60, a transporting assembly 70, a fixing device 80, and duplex copying assembly 90.

The copy sheet feeder 30 includes feeder decks 31, 32 and 33 and a manual feeder 34. Each of the feeder decks 31, 32 and 33 is such that copy sheets are placed on a placing plate 40 movable upward and downward between an upper feeding position and a lower replenishing position. In the feeding position, the uppermost one of a stack of copy sheets is in contact with a drivingly rotated feed roller 41 and fed thereby. The manual feeder 34 includes a manual insertion tray 341, and the uppermost one of a stack of copy sheets is in contact with a corresponding feed roller 41 and fed thereby.

Each of the feeder decks 31, 32, 33 and the manual feeder 34 includes a sheet sensor 38 disposed along a copy sheet feed path for detecting a copy sheet being fed. The sheet sensor 38 includes, e.g. a detecting portion which projects into the copy sheet feed path, rotates along a sheet feeding direction when the copy sheet comes into contact therewith, and returns to its initial position after the copy sheet passes, thereby projecting into the copy sheet feed path again, and a detecting member for detecting a rotation of the detecting portion. The sheet sensor 38 detects a leading end of the copy sheet being fed upon detecting the rotation of the detecting portion away from its initial position, while detecting a trailing end thereof upon detecting the rotation of the detecting portion toward its initial position.

The optical assembly 50 is provided with a light source unit including an exposure lamp 51 and a reflector 52, reflecting mirrors 53*a*, 53*b*, 53*c*, 53*d*, 53*e*, 53*f* and a lens 54. The light source unit and the reflecting mirror 53*a*, and the reflecting mirrors 53*b* and 53*c* are reciprocatingly movable at specified speeds in the lateral direction of FIG. 1, respectively. During the reciprocal movement of these elements, a document image is scanned to generate a light image representative thereof.

The image assembly 60 includes a photosensitive member 61 rotatably supported, and a main charger 62, a developing device 63, a transferring/separating device 64, a cleaning device 65 and a charge removing device 66 arranged in this order from an upstream side with respect to a rotating direction of the photosensitive member 61. The main charger 62 releases charges so that the surface of the photosensitive member 61 is uniformly charged at a predetermined voltage. Immediately downstream from the main charger 62, there is defined a light image exposed area where the surface of the photosensitive member 61 is exposed to the light image. Upon being exposed to the light image, an electrostatic latent image is formed on the surface of the photosensitive member 61. The developing device 63 attaches toner to the latent image to develop it into a toner image. The transferring/separating device 64 transfers the toner image on the surface of the photosensitive member 61 and, thereafter, separates the copy sheet from the surface of the photosensitive member 61. The cleaning device 65 removes the toner remaining on the surface of the photosensitive member 61 after the transferring operation. The charge removing device 66 removes charges remaining on the surface of the photosensitive member 61.

The transporting assembly 70 is provided, from an upstream side with respect to a transporting direction of a copy sheet, with a pair of transport rollers 71 for transporting a copy sheet fed from the feeder 30 toward the photosensitive member 61, a pair of feed rollers 74, a pair of registration rollers 75 which are driven in synchronism with a scanning timing of the optical assembly 50, a transport belt 76 for transporting the copy sheet separated from the photosensitive member 61, the fixing device 80 for fixing the transferred toner image onto the copy sheet, a pair of transport rollers 77 for transporting the copy sheet after the fixing operation, and a pair of discharge rollers 78 for discharging the copy sheet to the sorter 100.

A feed switch 72 and a registration switch 73 for detecting the copy sheet being transported are disposed at the upstream and downstream sides of the feed rollers 74, respectively. Between the transport rollers 77 and the discharge rollers 78, there are disposed an inversion guide 91 for switching a transport of the copy sheet to the sorter 100 and to the duplex copying assembly 90, and a fixation sensor 79 for detecting that a trailing end of the copy sheet being discharged to the sorter 100 via the discharge rollers 78 has passed the fixing device 80.

The duplex copying assembly 90 is provided with a first transport path 92 along which the copy sheet introduced to the duplex copying assembly 90 is transported, an intermediate stocking portion 93 for temporarily accommodating the copy sheet transported thereto, and a second transport path 94 along which the copy sheet is transported from the intermediate stocking portion 93 to the photosensitive member 61, faced upward The sorter 100 is provided with a discharge switching guide 101, a non-sorting bin 102 which is the uppermost discharge bin, and a sorting bin assembly 105 including a plurality of discharge bins. The non-sorting bin 102 and the sorting bin assembly 105 act as first and second copy sheet discharging portions. The discharge switching guide 101 is pivotally driven by an unillustrated driving device in accordance with a control signal output from a sorter controller to be described later, with the result that the discharge path of the copy sheet is switched to the non-sorting bin 102 and to the sorting bin assembly 105.

The sorting bin assembly 105 includes a bin elevating mechanism 106 which moves a stack of the respective discharge bins upward or downward stage by stage in synchronism with the discharge of the copy sheets from the main body 1, so that the discharged copy sheets can be placed on the respective bins.

The document feeder 10 is provided with a document feeding assembly 25 (see FIG. 2) including a feed roller 121, a transport belt 13, etc., a document setting portion 11 arranged upstream from the document feeding assembly 25, discharged sheet receptacles (document discharging portions) 17, 18 arranged downstream from the document feeding assembly, etc.

The document setting portion 11 includes a tray 110 and a document sensor 21. Document(s) is/are placed on the tray 110, faced downward. The document sensor 21 is disposed in the vicinity of the leading end of the tray 110 for detecting the presence of the document set in the tray 110, and may be a reflection type optical sensor including light emitting and receiving elements.

The document feeding assembly 25 (see FIG. 2) includes the feed roller 121, a pair of transport rollers 122, the transport belt 13, a discharge roller 14, switching guides 151, 152. The feed roller 121 is disposed in a specified position above the leading end of the tray 110 and comes into contact with the uppermost one of the set documents. The document fed from the tray 110 is transported to a specified position on the document platen 7 by the transport rollers 122 and the transport belt 13.

After having its image scanned by the optical assembly 50, the document on the platen 7 is discharged to the discharged sheet receptacle 17 or 18 by the transport belt 13 and the discharge roller 14.

In the case of simplex copying, the document is inverted by the switching guides 151, 152 and discharged onto the receptacle 17, faced upward. On the other hand, in the case of duplex copying, the document is brought back to the platen 7 via the switching guides 151, 152 after its surfaces are inverted. Upon completion of scanning of the rear surface of the document, the document is discharged to the receptacle 18 via the switching guide 151, faced upward.

Sensors 22, 23 and 24 are disposed along a transport path of the document to detect the document being transported. Specifically, the registration sensor 22, the inversion sensor 23 and the discharge sensor 24 are disposed immediately downstream from the transport rollers 122, downstream from the transport belt 13, and immediately upstream from the discharged sheet receptacle 17 with respect to the document transporting direction, respectively. Each of the sensors 22, 23 and 24 includes, e.g. a detecting portion which projects into the document transport path, rotates along a document transporting direction when the document comes into contact therewith, and returns to its initial position after the document passes, thereby projecting into the document transport path again, and a detecting member for detecting a rotation of the detecting portion. Each sensor detects a leading end of the document being fed upon detecting the rotation of the detecting portion away from its initial position, while detecting a trailing end thereof upon detecting the rotation of the detecting portion toward its initial position.

Figure 2:
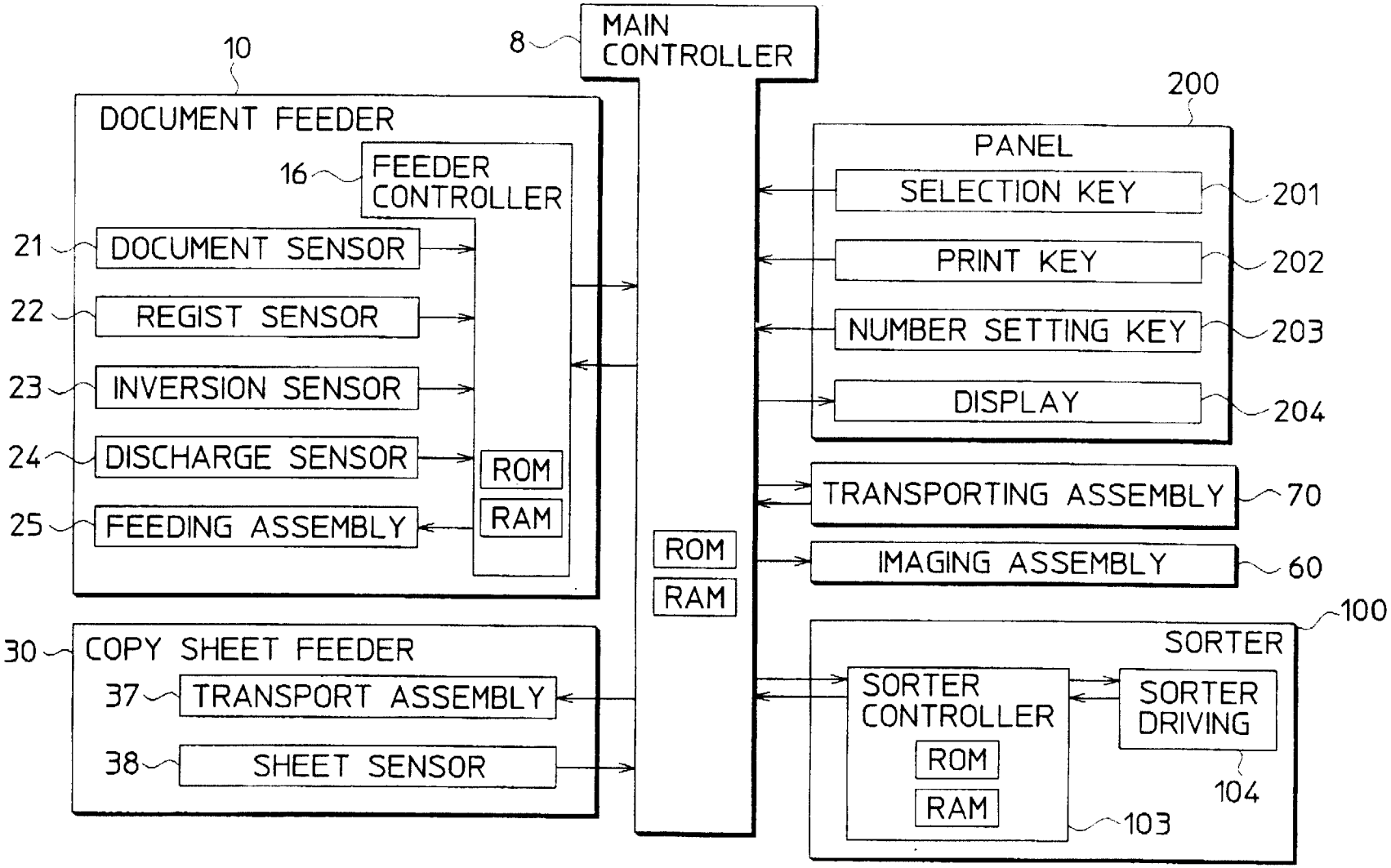
FIG. 2 is a construction block diagram of a first embodiment of a controller of the image forming apparatus.

Next, a control construction of the image forming apparatus as a first embodiment is described with reference to the block diagram of FIG. 2.

The image forming apparatus is provided with an operation/display panel 200 including a variety of input switches, a main controller 8 for controlling the main body 1 in accordance with signals sent from the panel 200, a document feeder controller 16 for controlling the document feeder 10, and a sorter controller 103 for controlling the sorter 100. The main controller 8 conducts a serial communication with the other controllers 16 and 103 by sending and receiving a variety of data and timing pulses, thereby controlling the operation of all the elements.

On the operation/display panel 200, there are arranged setting keys including a feeder selection key 201, a print key 202, a copy number setting key (copy number setting device) 203, a magnification setting key, and a display 204. The feeder selection key 201 is operated to select one of the feeder decks 31, 32, 33 and the manual feeder 34. The print key 202 is operated to start a copying operation. The copy number setting key 203 is operated to set how many copies are to be made for one document. The display 204 includes, for example, a liquid crystal display or a LED and is adapted to display the feeder selected by the feeder selection key 201, the number of copies to be made which is set by the copy number setting key 203, a magnification set by the magnification setting key, etc.

The feeder controller 16 includes a microcomputer provided with a ROM for storing a control program of the document feeder 10 and a RAM for temporarily storing data, and controls the operation of the respective elements of the document feeding assembly 25. The feeder controller 16 counts a time which lapses until the registration sensor 22 detects the trailing end of the document after detecting the leading end thereof during the feed of the document, and determines that the document has been jammed in the feeding assembly 25 if the counted time is longer than a predetermined time.

The feeder controller 16 also counts a time which lapses until the inversion sensor 23 detects the trailing end of the document after detecting the leading end thereof while the surface of the document is inverted in the case of duplex copying or while the document is being discharged, and determines that the document has been jammed in the inverting assembly if the counted time is longer than a predetermined time. Further, the feeder controller 16 counts a time which lapses until the discharge sensor 24 detects the trailing end of the document after detecting the leading end thereof while the document is discharged to the discharged sheet receptacle 17, and determines that the document has been jammed in the discharging assembly if the counted time is longer than a predetermined time.

In the case that the document is jammed in the inverting assembly, i.e. in the case that the document has normally passed the inversion sensor (first detector) 23, but is jammed where the discharged sensor (second detector) 24 is disposed, a next document can be set in the specified position on the document platen 7 since the trailing end of the document already passed the inversion sensor 23.

Upon the jam of the document in the discharging assembly, the feeder controller 16 permits the next document to remain on the document platen 7 if it is already set, continues the document setting operation if the next document is not yet set, and starts the document setting operation if it has not yet started.

Further, upon the jam of the document being fed, the feeder controller 16 informs the main controller 8 of it and the kind of the jam.

The main controller 8 includes a microcomputer provided with a ROM for storing a control program of the main body 1 and a RAM for temporarily storing data, and starts a copying operation when the print key 202 is pressed. The main controller 8 also controls the operation of the respective elements of the imaging assembly 60 and transporting assembly 70 in accordance with the contents set by the setting keys such as the magnification setting key. Further, the main controller 8 controls the operation of the respective elements of the copy sheet feeder 30 in accordance with the content selected by the feeder selection key 201.

The main controller 8 also counts the number of fed copy sheets based on the detection result of the sheet sensor 38, and resets the count value when the number of fed copy sheets reaches the number of copies to be made which was set by the copy number setting key 203.

The main controller 8 is also provided with an imaging controller which completes the copying operation to obtain the number of copies which was set by the copy number setting key 203 unless the document is the last one of the documents placed on the tray 110, i.e. if a next document is set on the document platen 7 when the document is jammed in the discharging assembly. Upon completion of the copying operation, the main controller 8 stops the imaging operation.

The sorter controller 103 includes a microcomputer provided with a ROM for storing a control program of the sorter 100 and a RAM for temporarily storing data, and controls the operation of the respective elements of a sorter driving mechanism 104 of the sorter 100 including pairs of transport rollers, the bin elevating mechanism 106, and the switching guide 101.

Next, the operation of the thus constructed image forming apparatus is described.

When the print key 202 is pressed after the magnification and other information are set in the operation/display panel 200, the number of copies to be made is set by the copy sheet setting key 203, and the feeder is selected by the selection key 201, the copying operation is started.

More specifically, the first document placed on the tray 110 is fed to the specified position on the document platen 7, and the light from the light source unit is reflected by the document on the document platen 7. The reflected light is introduced to the lens 54 via the reflecting mirrors 53*a* to 53*c*, and then to the photosensitive member 61 via the reflecting mirrors 53*d* to 53*f*. Consequently, the photosensitive member 61 is exposed to the reflected light.

At this stage, the surface of the photosensitive member 61 is uniformly charged by the charger 62. Upon being exposed to the light via the optical assembly 50, an electrostatic latent image is formed on the surface of the photosensitive member 61. Subsequently, charged toner supplied from the developing device 63 to the photosensitive member 61 is attached to the latent image to develop it into a toner image.

On the other hand, a copy sheet is transported to the pair of registration rollers 75 by a transport assembly 37 (see FIG. 2) of the feeder 30 and the transport assembly 70. Subsequently, the copy sheet is transported from the registration rollers 75 to the space between the photosensitive member 61 and the transferring/separating device 64 in synchronism with the operation of the optical assembly 50.

The toner image on the photosensitive member 61 is transferred by the transferring/separating device 64 to the copy sheet, which is in turn separated from the photosensitive member 61. The separated copy sheet is transported by the transport belt 76 to the fixing device 80 where the toner image is fixed onto the copy sheet. Thereafter, the copy sheet is transported by the transport rollers 77 to be discharged to, e.g. the sorter 100 via the discharge rollers 78.

After making as many copies as set by the copy number setting key by the above operation, the document on the document platen 7 is discharged in the document feeder 10 and a next document placed on the tray 100 is transported to the document platen 7 to continue the copying operation.

Figure 3:
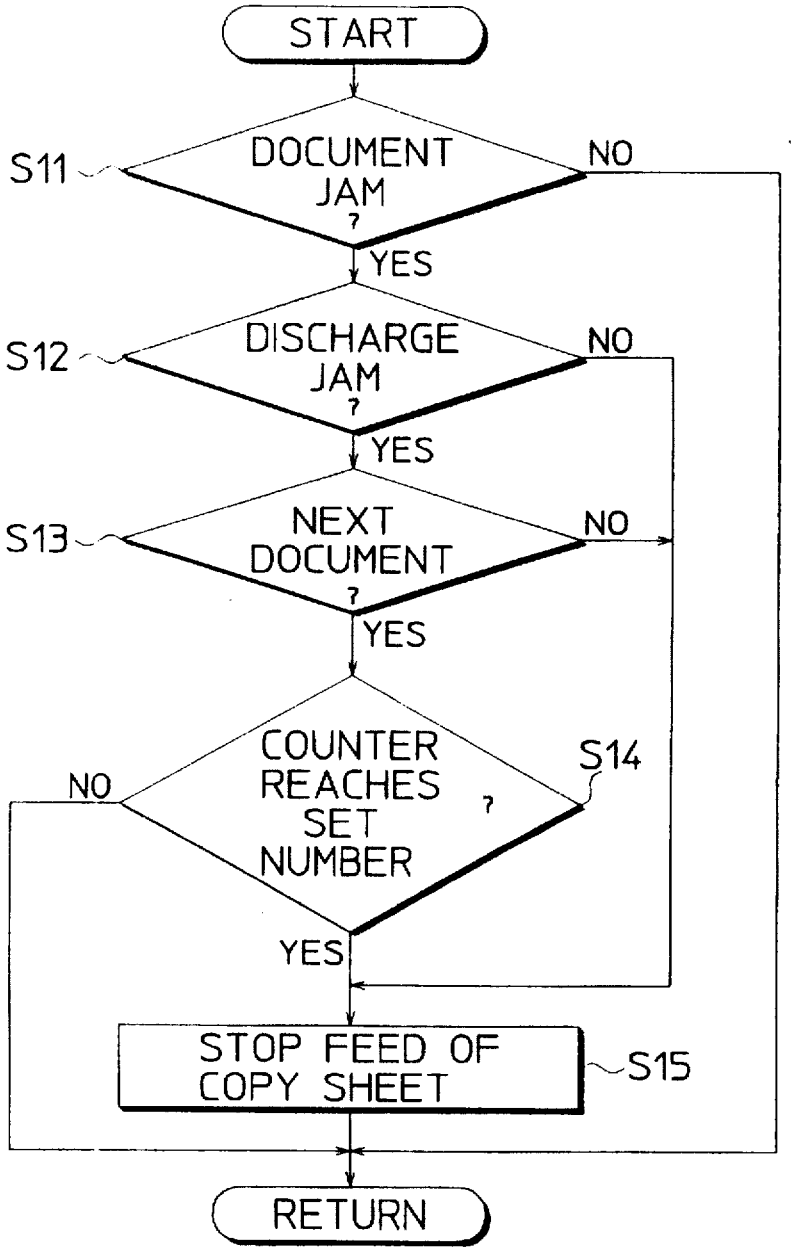
FIG. 3 is a flowchart showing an operation performed when a document to be discharged is jammed.
Figure 4:
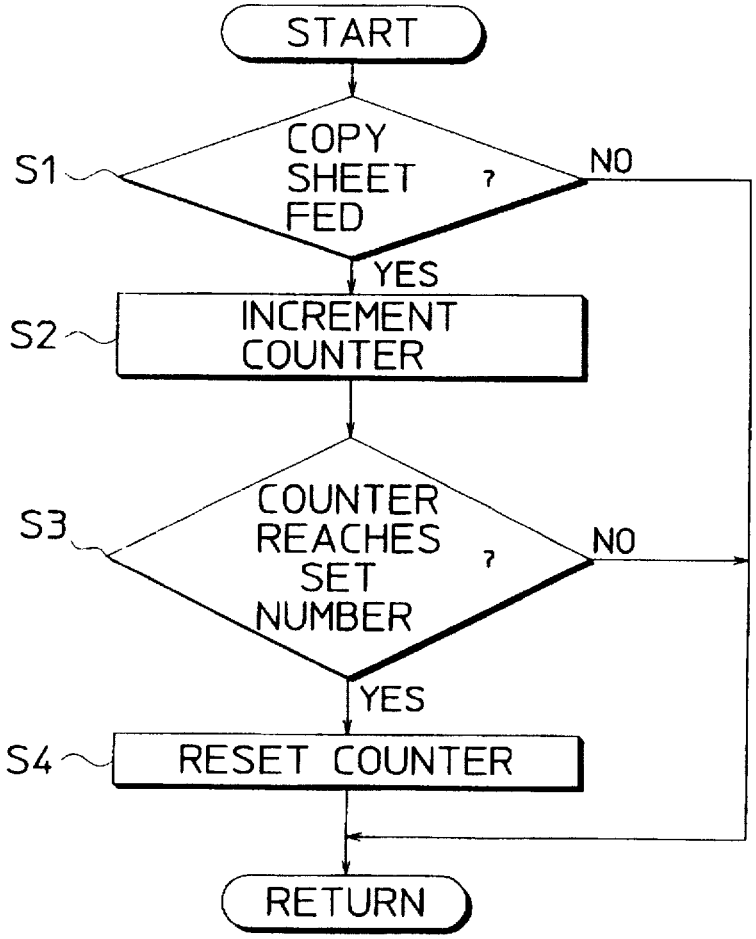
FIG. 4 is a flowchart showing an operation of counting how many times sheets have been fed.

The operation procedure when the document is jammed is described with reference to FIGS. 3 and 4. First, an exemplary subroutine "Feed Number Count" is described with reference to FIG. 4.

It is first discriminated whether a copy sheet has been fed (Step S1). This subroutine returns if the discrimination result is in the negative (NO in Step S1), while a value of a feed counter is incremented (Step S2) if it is in the affirmative (YES in Step S1). Subsequently, it is discriminated whether the value of the feed counter is equal to the set number of copies to be made (Step S3). This subroutine returns if the discrimination result is in the negative (YES in Step S3), while the value of the feed counter is reset to 0 (Step S4) if it is in the affirmative (NO in Step S3).

Next, an exemplary subroutine "Document Jam Processing" is described with reference to FIG. 3.

First, it is discriminated whether the document has been jammed while being fed (Step S11). This subroutine returns if the discrimination result is in the negative (NO in Step S11), while it is discriminated whether the document has been jammed in the discharging assembly (Step S12) if it is in the affirmative (YES in Step S11). If the document has been jammed in the discharging assembly (YES in Step S12), it is then discriminated whether the jammed document is not the last document to be copied, i.e. whether a next document has been fed and set on the document platen 7 (Step S13).

If the next document is set (YES in Step S13), it is discriminated whether the value of the feed counter is equal to the set number of copies to be made (Step S14). This is because a copy sheet may have been fed for the next document when the document is discriminated to have been jammed in the discharging assembly. This subroutine returns unless the value of the feed counter is equal to the set number of copies to be made (NO in Step S14).

On the other hand, if the document has not been jammed in the discharging assembly (NO in Step S12), the document jammed in the discharging assembly is the last document (NO in Step S13), or the value of the feed counter is equal to the set number of copies to be made (YES in Step S14), the feed of the copy sheet is stopped (Step S15) and this subroutine returns.

As described above, in the case where the document has been jammed in the discharging assembly of the document feeder 10, the feed of the copy sheet(s) is continued until the set number of copy sheets are fed because the jammed document does not stand as a hindrance in setting the next document on the document platen 7. Accordingly, the copying operation for the properly set document can be securely performed.

Thus, the properly scanned documents and the improperly scanned documents can be clearly distinguished from each other. This securely prevents the documents from being copied more than or less than intended when the copying operation is resumed after the jammed document is removed, thereby improving the operability of the image forming apparatus and the working efficiency of an operator.

In this embodiment, the jam of the document in the discharging assembly which allows the next document to be properly set on the document platen 7 is detected based on whether the former document has normally passed the inversion sensor 23. However, according to the invention, this detection is not limited to the above. For example, the above detection can be made only by the discharge sensor 24 by lengthening a document transport path from the document platen 7 to the discharged sheet receptacle 17 and by setting a distance between a downstream end of the document platen 7 with respect to the document transporting direction and the discharge sensor 24 longer than the maximum dimension of documents placeable on the tray 110 in the document transporting direction.

Figure 5:
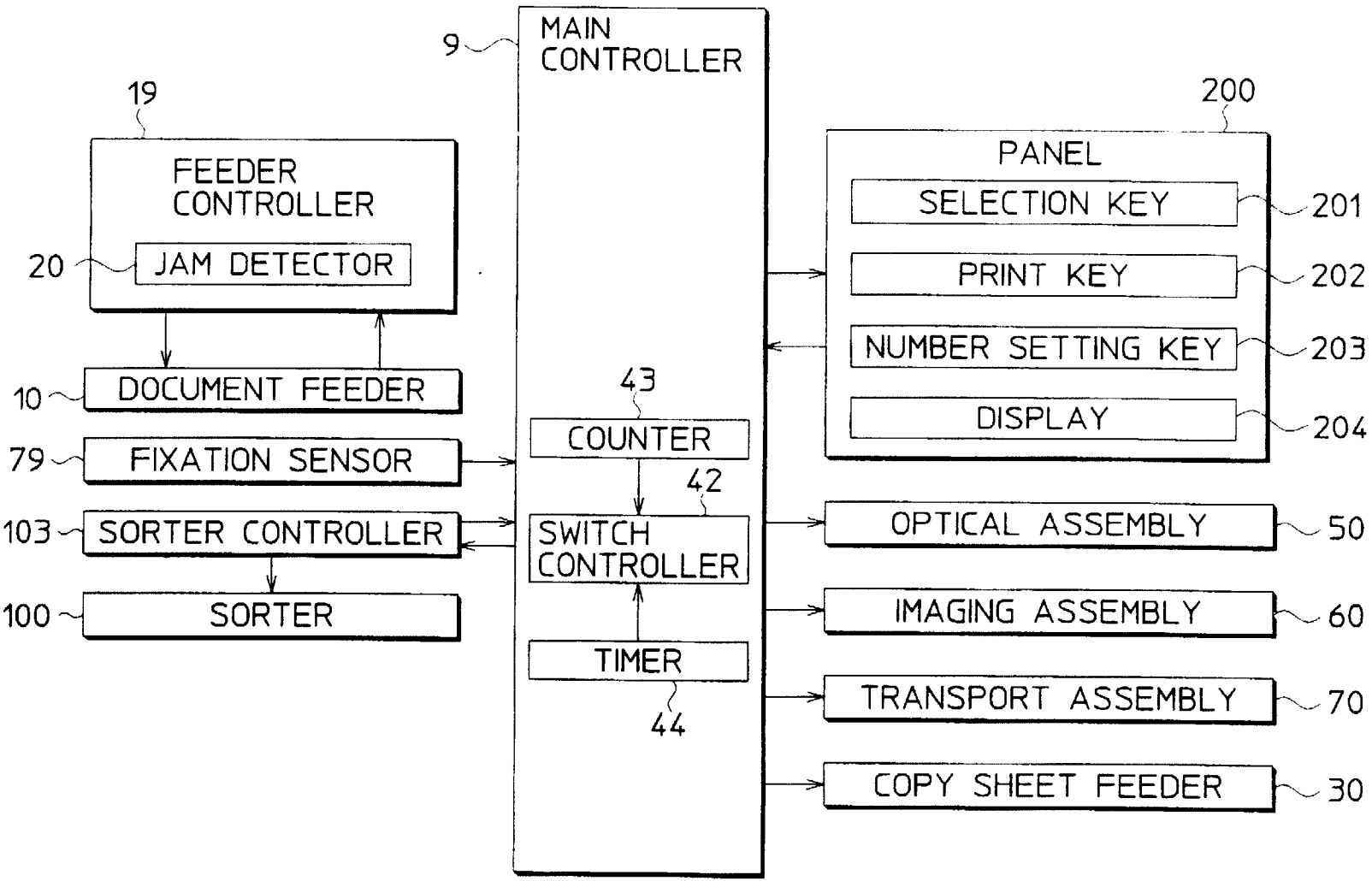
FIG. 5 is a construction block diagram of a second embodiment of a controller of the image forming apparatus.

Next, a control construction of the image forming apparatus as a second embodiment is described with reference to a block diagram of FIG. 5.

The image forming apparatus is provided with an operation/display panel 200 including a variety of input switches, a main controller 9 for controlling the main body 1 in accordance with signals input from the panel 200, a document feeder controller 19 for controlling the document feeder 10, and a sorter controller 103 for controlling the sorter 100. The main controller 9 conducts a serial communication with the other controllers 19 and 103 by sending and receiving a variety of data and timing pulses, thereby controlling the operation of all the elements.

Similar to the first embodiment, on the operation/display panel 200, there are arranged inputting means including a feeder selection key 201, a print key 202, a copy number setting key (copy number setting device) 203 a magnification setting key, and a display 204.

The feeder selection key 201 is operated to select one of the feeder decks 31, 32, 33 and the manual feeder 34. The print key 202 is operated to start a copying operation.

The copy number setting key 203 constitutes a copy number setting device for setting the number of copies to be made for each document. The display 204 includes, for example, a liquid crystal display or a LED and is adapted to display the feeder selected by the feeder selection key 201, the number of copies to be made which is set by the copy number setting key 203, a magnification set by the magnification setting key, etc.

The feeder controller 19 includes a microcomputer provided with a ROM for storing a control program of the document feeder 10 and a RAM for temporarily storing data, and outputs control signals used to control the operation of the respective elements of the document feeding assembly 25.

The feeder controller 19 includes a document jam detector 20 which counts a time which lapses until the registration sensor 22 or the like detects the trailing end of the document being fed after detecting the leading end thereof during the feed of the document, and determines that the document has been jammed during the use of the document feeder 10 if the counted time is longer than a predetermined time. The document jam may be a document jam in the feeding assembly which is detected by the registration sensor 22, a document jam in the inverting assembly which is detected by the inversion sensor 23 or a document jam in the discharging assembly which is detected by the discharge sensor 24. When the document jam detector 20 confirms the jam of the document, a document jam detection signal is sent to the main controller 9.

The main controller 9 includes a microcomputer provided with a ROM for storing a control program of the main body 1 and a RAM for temporarily storing data, and outputs control signals to the respective elements of the main body 1 so as to start a copying operation when the print key 202 is pressed. The main controller 8 also sends control signals to the respective elements of the optical assembly 50, imaging assembly 60 and transporting assembly 70 in accordance with the contents set by the setting keys such as the magnification setting key, and sends control signals to the respective elements of the copy sheet feeder 30 in accordance with the content selected by the feeder selection key 201.

The main controller 9 also includes a discharged sheet counter 43 for counting the number of discharged copy sheets in accordance with a detection signal from a fixation sensor 79 provided in the fixing device 80, and a timer 44 for measuring a time which lapses after the output of the detection signal from the fixation sensor 79 until the trailing end of the copy sheet reaches a position where the switching guide (switching portion) 101 is disposed. The fixation sensor 79 and the timer 44 constitute a position detector for detecting that the trailing end of the copy sheet bearing the copied image has reached the switching guide 101.

More specifically, the timer 44 measures a time predetermined in accordance with a distance between the fixation sensor 79 and the switching guide 101 and a transporting speed of the copy sheet. The position detector confirms that the trailing end of the document reaches the switching guide 101 upon lapse of the predetermined time after it passes the fixation sensor 79.

The main controller 9 also includes a switch controller 42. When confirming a document jam in accordance with the detection signal from the document jam detector 20, the switch controller 42 confirms that the trailing end of the last one of the copy sheets corresponding to the document before occurrence of the jam has passed the switching guide 101 in accordance with the output signals from the copy number setting key 203, the discharged sheet counter 43 and the timer 44, and outputs to the sorter controller 103 a control signal to switch a discharging direction of the copy sheet.

More specifically, during the continuous copying operation for copying the document image on the number of copy sheets input by the copy number setting key 203, the switch controller 42 compares the set copy number and the number of copy sheet(s) which has/have passed the fixation sensor 79 in accordance with the output signals from the copy number setting key 203 and the discharged sheet counter 43. In this way, the switch controller 42 discriminates whether the number of copies corresponding to the input copy number have been made for each of the documents fed one after another to the document platen 7 in the document feeder 10.

Upon confirmation of the occurrence of the document jam by the document jam detector 20, the switch controller 42 sets the timer 44 when the trailing end of the last copy sheet passes the fixation sensor 79. Upon lapse of the predetermined time, the switch controller 42 determines that the trailing end of the last copy sheet has passed the switching guide 101 and sends a control signal to the sorter controller 103, thereby controlling the switching guide 101 to switch the discharging direction of the copy sheet.

The main controller 9 stops the entire image forming operation after all copy sheets in the transporting assembly 70 which had been already fed from the copy sheet feeder 30 when the document jam occurred are discharged to specified sorting bins.

The sorter controller 103 including a microcomputer provided internally with a ROM for storing a control program of the sorter 100 and a RAM for temporarily storing data, and controls the operation of the respective elements of the sorter 100 such as the transport rollers, the bin elevating mechanism 106 and a driving device for the switching guide 101. For example, upon output of the switching signal from the switch controller 42 when the switching guide 101 is set to discharge the copy sheet to the non-sorting bin 102, the sorter controller 103 executes such a control as to switch the discharging direction of the copy sheet to the sorting bin assembly 105.

Next, the operation of the thus constructed image forming apparatus is described. When the print key 202 is pressed after the magnification and other information are set in the operation/display panel 200, the number of copies to be made is set by the copy sheet setting key 203, and the feeder is selected by the selection key 201, the copying operation is started.

More specifically, the first document placed on the document setting portion 110 is fed to the specified position on the document platen 7, and the light from the light source unit is reflected by the document on the document platen 7. The reflected light is introduced to the lens 54 via the reflecting mirrors 53*a* to 53*c*, and then to the photosensitive member 61 via the reflecting mirrors 53*d* to 53*f*. Consequently, the photosensitive member 61 is exposed to the reflected light. At this stage, the surface of the photosensitive member 61 is uniformly charged by the charger 62. Upon being exposed to the light via the optical assembly 50, an electrostatic latent image is formed on the surface of the photosensitive member 61. Subsequently, charged toner supplied from the developing device 63 to the photosensitive member 61 is attached to the latent image to develop it into a toner image.

On the other hand, a copy sheet is transported to the pair of registration rollers 75 by the transport assembly 70 after being fed from the copy sheet feeder 30. Subsequently, the copy sheet is transported from the registration rollers 75 to the space between the photosensitive member 61 and the transferring/separating device 64 in synchronism with the operation of the optical assembly 50. The toner image on the photosensitive member 61 is transferred by the transferring/separating device 64 to the copy sheet, which is in turn separated from the photosensitive member 61. The separated copy sheet is transported by the transport belt 76 to the fixing device 80 where the toner image is fixed onto the copy sheet. Thereafter, the copy sheet is transported by the transport rollers 77 to be discharged to, e.g. the sorter 100 via the discharge rollers 78.

After making as many copies as set by the copy number setting key by the above operation, the document on the document platen 7 is discharged in the document feeder 10 and a next document placed in the document setting portion 11 is transported to the document platen 7 to continue the copying operation.

Figure 6:
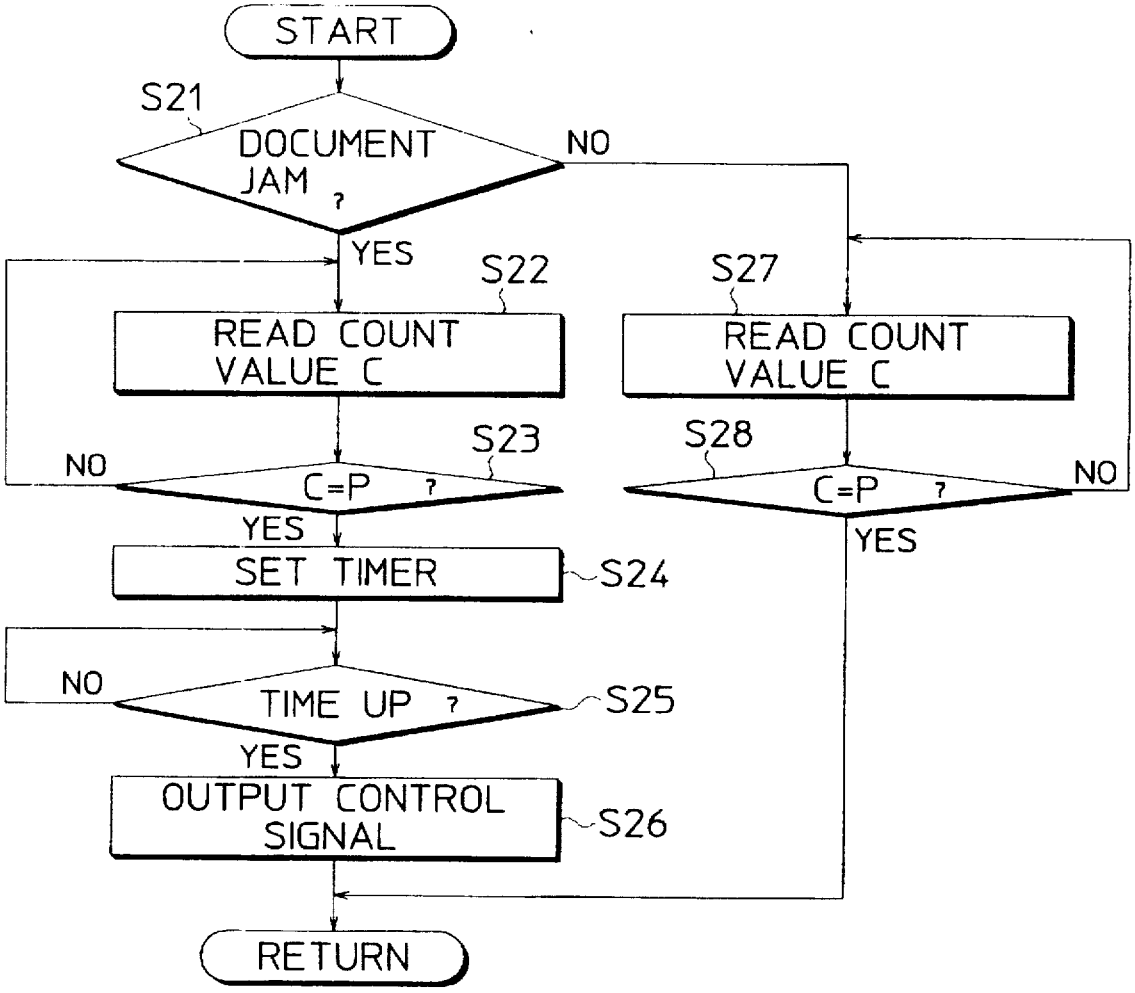
FIG. 6 is a flowchart showing a control operation of the second embodiment of the controller.

Next, the control executed when the document is jammed during the use of the document feeder 10 is described with reference to a flowchart shown in FIG. 6. Upon start of the control, whether the document has been jammed is discriminated in accordance with the detection signal from the document jam detector 20 (Step S21). A count value C of the feeder counter 43 is read (Step S22) if the discrimination result is in the affirmative (YES in Step S21). Then, it is discriminated whether the count value C is equal to a preset copy number P set by the copy number setting key 203 (Step S23).

This subroutine returns to Step S22 if the discrimination result in Step S23 is in the negative, and then it is discriminated again whether the count value P is equal to the preset copy number P. The timer 44 is set (Step S24) when the count value P becomes equal to the preset copy number P. Subsequently, it is discriminated whether the timer 44 has measured the predetermined time (Step S25). Upon confirming the lapse of the predetermined time, the control signal to switch the discharging direction of the copy sheet is output (Step S26).

If the discrimination result in Step S21 is in the negative, the count value C of the feeder counter 43 is read (Step S27) and it is discriminated whether the count value C is equal to a preset copy number P set by the copy number setting key 203 (Step S28). This subroutine returns to Step S27 if the discrimination result in Step S28 is in the negative, and then it is discriminated again whether the count value P is equal to the preset copy number P.

This subroutine returns to repeat the above-described control when the discrimination result in Step S28 is in the affirmative, thereby controllably discriminating whether a next document to be fed from the document feeder 10 to the document platen 7 is jammed.

As described above, the document jam detector 20 detects whether the document jam has occurred during the use of the document feeder 10. Upon detection of the document jam, the position detector including the fixation sensor 79 and the timer 44 detects that the trailing end of the copy sheet bearing the copied image has reached the switching guide 101, and the discharging direction of the copy sheet is switched by means of the switching guide 101. Accordingly, without temporarily stopping the transport of the copy sheets, the copy sheets bearing normally copied images and the copy sheets unused due to the document jam can be suitably discharged to the separate discharged sheet receptacles.

More specifically, in the image forming apparatus constructed such that a plurality of copy sheets are continuously fed from the copy sheet feeder 30 to the transporting assembly 70 to shorten an image forming time, the switching timing of the switching guide 101 when the document jam occurs is set as above. Accordingly, the plurality of copy sheets continuously transported can be accurately separately discharged to one and the other of the non-sorting bin 102 and the sorting bin assembly 105.

Unlike the prior art apparatuses constructed such that the transport of the copy sheet is stopped where the registration rollers 75 are disposed, the apparatus according to the foregoing embodiment does not require a long time to deal with jammed copy sheets and effectively prevents a jam of copy sheets due to a deterred flow thereof resulting from a temporarily stop of the rotation of the registration rollers 75.

Further, according to the foregoing embodiment, in the image forming apparatus constructed such that a number of copy sheets input by the copy number setting key 203 are continuously fed to the imaging assembly 60, there is provided the feed counter 43 for counting the number of copy sheets transported from the imaging assembly 60 to the copy sheet discharging device. When the document jam occurs, the discharging direction of copy sheets is switched after it is confirmed that the trailing end of the last one of the copy sheets fed before the document jam has reached the switching guide 101 in accordance with the output signals from the copy number setting key 203, the position detector and the feed counter 43. Thus, the copy sheets corresponding to the document before the document jam and those corresponding to the document after the document jam can be accurately distinguished and separately discharged to the separate copy sheet discharging devices.

Further, a plurality of copy sheets which have been fed one after another to the transporting assembly 70 at specified intervals can be accurately separated into those bearing the copied images and those bearing no copied images, and a jam of the copy sheets can be effectively prevented by preventing the copy sheets from being placed one over another in their transport path.

Furthermore, in the case that the position detector is provided which includes the fixation sensor 79 for detecting that the trailing end of the copy sheet has passed the fixing device 80, and the timer 44 for measuring a time which lapses after output of the detection signal from the fixation sensor 79 until the trailing end of the copy sheet reaches the switching guide 101, the construction can be advantageously simplified since the position detector can be formed using the existing sensor provided to discriminate whether the copy sheet has been jammed in the fixing device 80 or the like.

A photosensor or the like may be disposed in the vicinity of the switching guide 101 to directly detect that the trailing end of the copy sheet has reached the switching guide 101. Further, the sorter 100 may be provided with a bin specially for receiving the unused copy sheets.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An image forming apparatus, comprising:

a document feeder for feeding a document to an image scanning portion for scanning an image of the document;

a document jam detector which detects a jam of the document in the document feeder;

a controller which stops, when the document jam detector detects the document jam, the entire image forming operation after completing a specified operation, the document feeder including a document setting portion for setting documents to be fed to the image scanning portion, a document discharging assembly for receiving the document discharged from the image scanning portion, means for setting a next document in the image scanning portion while the former document is discharged to the document discharging assembly;

the document jam detector including a discharge document jam detecting device for detecting a document jam in the document discharging assembly such that the next document is settable in the image scanning portion, wherein the discharge document jam detecting device includes:

a first detecting device which detects the trailing end of the document to be discharged has completely left the image scanning portion; and a second detecting device which is disposed downstream from the first detecting device and detects that the document has discharged from the document feeder; and wherein when the first detecting device detects a departure of the document from the image scanning portion and the second detecting device does not detect a discharge of the document from the document feeder, the discharge document jam detecting device detects the document jam in the document assembly and the document feeder sets the next document in the image scanning position; and the controller including an imaging control device which completes the image forming operation for the next document when the discharge document jam detecting device detects the document jam in the document discharging assembly.

2. The image forming apparatus according to claim 1 wherein the second detecting device is disposed a distance downstream from the image scanning position a distance greater than a length of the document in a feeding direction of the document feeder.

3. An image forming apparatus, comprising:

a document feeder for feeding a document to an image scanning portion for scanning an image of the document;

a document jam detector which detects a document jam of the document in the document feeder;

a controller which stops an image forming operation after completing a specified operation in response to the document jam detector detecting the document jam;

a first copy sheet discharging portion for receiving a discharged copy sheet bearing a copied image;

a second copy sheet discharging portion for receiving a discharged copy sheet bearing no copied image;

a switching portion for switching a discharging direction of a copy sheet between a first discharging direction to the first copy sheet discharging portion and a second discharging direction to the second copy sheet discharging portion;

a copy number setting device which sets a number of copies to be made for each document to be fed to the image scanning portion;

a copy sheet transporting assembly which continuously transports copy sheets corresponding to the number set by the copy number setting device to an imaging assembly for forming the document image on the copy sheet;

a counter which counts the number of copy sheets discharged from the imaging assembly to the first copy sheet discharging portion;

a position detecting device for detecting, upon occurrence of document jam, that a trailing end of a copy sheet bearing the copied image has reached the switching portion in accordance with the copy number set by the copy number setting device and the number of copy sheets counted by the counter being equal; and the controller including a switch controlling device for controlling the switching portion to switch the discharging direction upon confirming in accordance with a detection signal from the position detecting device that the trailing end of the copy sheet bearing the copied image has reached the switching portion after detection of the document jam by the document jam detector.

4. An image forming apparatus, comprising:

a document feeder for feeding a document to an image scanning portion for scanning an image of the document;

a document jam detector which detects a document jam of the document in the document feeder;

a controller which stops an image forming operation after completing a specified operation in response to the document jam detector detecting the document jam;

a first copy sheet discharging portion for receiving a discharged copy sheet bearing a copied image;

a second copy sheet discharging portion for receiving a discharged copy sheet bearing no copied image;

a switching portion for switching a discharging direction of a copy sheet between a first discharging direction to the first copy sheet discharging portion and a second discharging direction to the second copy sheet discharging portion;

a position detecting device which detects that the trailing end of a copy sheet bearing the copied image has reached the switching portion, the position detecting device including:

a fixation sensor which detects that the trailing end of the copy sheet bearing the copied image has passed a fixing device for fixing the image onto the copy sheet; and a timer which measures a time required for the trailing end of the copy sheet to reach the switching portion after being detected by the fixation sensor; and the controller including a switch controlling device for controlling the switching portion to switch the discharging direction upon confirming in accordance with a detection signal from the position detecting device that the trailing end of the copy sheet bearing the copied image has reached the switching portion after detection of the document jam by the document jam detector.

5. An image forming apparatus, comprising:

a document feeder for feeding a document to an image scanning portion for scanning an image of the document;

a document jam detector which detects a document jam of the document in the document feeder;

a controller which stops an image forming operation after completing a specified operation in response to the document jam detector detecting the document jam;

a copy number setting device which sets a number of copies to be made for each document to be fed to the image scanning portion;

a copy sheet transporting assembly which continuously transports copy sheets corresponding to the number set by the copy number setting device to an imaging assembly for forming the document image on the copy sheet;

a copy sheet discharging portion for receiving a discharged copy sheet bearing a copied image;

a counter which counts the number of copy sheets discharged from the imaging assembly to the copy sheet discharging portion;

a switching portion for switching a discharging direction of a copy sheet between a first direction to the copy sheet discharging portion and a second direction away from the copy sheet discharging portion;

a position detecting device for detecting, upon occurrence of a document jam, that a trailing end of a copy sheet bearing the copied image has reached the switching portion in accordance with the copy number set by the copy number setting device and the number of copy sheets counted by the counter being equal; and the controller including a switch controlling device for controlling the switching portion to switch the discharging direction upon confirming in accordance with a detection signal from the position detecting device that the trailing end of the copy sheet bearing the copied image has reached the switching portion after detection of the document jam by the document jam detector.

6. An image forming apparatus, comprising:

a document feeder for feeding a document to an image scanning portion for scanning an image of the document;

a document jam detector which detects a document jam of the document in the document feeder;

a controller which stops an image forming operation after completing a specified operation in response to the document jam detector detecting the document jam;

a copy sheet discharging portion for receiving a discharged copy sheet bearing a copied image;

a switching portion for switching a discharging direction of a copy sheet between a first direction to the copy sheet discharging portion and a second direction away from the copy sheet discharging portion;

a position detecting device which detects that the trailing end of a copy sheet bearing the copied image has reached the switching portion, the position detecting device including:

a fixation sensor which detects that the trailing end of the copy sheet bearing the copied image has passed a fixing device for fixing the image onto the copy sheet; and a timer which measures a time required for the trailing end of the copy sheet to reach the switching portion after being detected by the fixation sensor; and the controller including a switch controlling device for controlling the switching portion to switch the discharging direction upon confirming in accordance with a detection signal from the position detecting device that the trailing end of the copy sheet bearing the copied image has reached the switching portion after detection of the document jam by the document jam detector.

7. An image forming apparatus, comprising:

a document feeder for feeding a document to an image scanning portion for scanning an image of the document;

a document jam detector which detects a jam of the document in the document feeder;

a controller which stops, when the document jam detector detects the document jam, the entire image forming operation after completing a specified operation, the document feeder including a document setting portion for setting documents to be fed to the image scanning portion, a document discharging assembly for receiving the document discharged from the image scanning portion, means for setting a next document in the image scanning portion while the former document is discharged to the document discharging assembly;

the document jam detector including a discharge document jam detecting device for detecting a document jam in the document discharging assembly such that the next document is settable in the image scanning portion, wherein the discharge document jam detecting device includes a detecting device, disposed downstream from the image scanning portion a distance greater than a length of the document discharged from the image scanning portion in a feeding direction of the document feeder, for detecting a jam of the document discharged from the image scanning portion permitting the document feeder to set the next document in the image scanning position; and the controller including an imaging control device which completes the image forming operation for the next document when the discharge document jam detecting device detects the document jam in the document discharging assembly.

* * * * *